United States Patent [19]

Richardson et al.

[11] 4,437,521

[45] Mar. 20, 1984

[54] SUBSEA WELLHEAD CONNECTION ASSEMBLY AND METHODS OF INSTALLATION

[75] Inventors: Emmett M. Richardson, Duncanville; Angelos T. Chatas, Dallas; Joseph R. Padilla, Houston, all of Tex.

[73] Assignee: Mobil Oil Corporation, New York, N.Y.

[21] Appl. No.: 371,901

[22] Filed: Apr. 26, 1982

[51] Int. Cl.[3] ..... E21B 43/01

[52] U.S. Cl. ..... 166/341; 166/347; 166/366; 166/368

[58] Field of Search ..... 166/341–347, 166/366, 368

[56] References Cited

U.S. PATENT DOCUMENTS

| | | | |
|---|---|---|---|
| 3,090,437 | 5/1963 | Geer | 166/341 X |
| 3,556,208 | 1/1971 | Dean | 166/356 X |
| 4,036,295 | 7/1977 | Kirkland et al. | 166/344 X |
| 4,175,620 | 11/1979 | Nolan, Jr. et al. | 166/343 |
| 4,191,256 | 3/1980 | Croy et al. | 166/343 |

*Primary Examiner*—Ernest R. Purser
*Assistant Examiner*—Thuy M. Bui
*Attorney, Agent, or Firm*—Alexander J. McKillop; Michael G. Gilman; George W. Hager, Jr.

[57] ABSTRACT

A subsea wellhead connection assembly for establishing fluid communication and production capability between a subsea wellhead and an adjacent subsea manifold system. The assembly includes conduit means for fluidly connecting the wellhead and the manifold system, the conduit means having one end extending substantially horizontally and the other end situated below the horizontal end; wellhead connector means fluidly connected to the lower end of the conduit means for releasably connecting the conduit means to the wellhead upon downward movement of the assembly to establish fluid communication therebetween; manifold system connector means fluidly connected to the horizontal end of the conduit means for releasably connecting the conduit means to the manifold system upon lateral movement of the manifold system connector means to establish fluid communication therebetween; and a guide frame rigidly secured to the wellhead connector means for supporting the manifold system connector means and the conduit means, and for vertically aligning the wellhead connector means over the wellhead and horizontally aligning the manifold system connector means with the manifold system. A method of establishing fluid communication and production capability between a marine floor wellhead and an adjacent subsea manifold system employing the aforecited wellhead connection assembly components is also disclosed.

17 Claims, 9 Drawing Figures

61
41
13
63
19
78
60
15
70
19
55
67
66
80
50
11
81
16

15
82
56
82
84
49
87
51
51
89
86
62
95
88
65
60
88
98
54

32
36
13
PDT LUBRICATOR
PDT-TOOL INJECTOR
HYDRAULIC ACCUMULATORS
NITROGEN
39
35
AIR
26

100
61
100
41
13
60
15
15
19
19
100
100
35
38
26
25
14
16
101
11

SUBSEA WELLHEAD CONNECTION ASSEMBLY AND METHODS OF INSTALLATION

BACKGROUND OF THE INVENTION

This invention relates generally to a subsea wellhead connection assembly for establishing fluid communication and production capability between a subsea wellhead and an adjacent subsea atmospheric manifold system. In particular, the invention relates to such a connection assembly for use in a subsea well completion system for handling oil and/or gas production from multiple offshore template-drilled wells, as well as methods for installing the connection assembly in a subsea well completion system. In addition to the recovery of hydrocarbons, the present invention also relates to the recovery of subaqueous deposits of sulfur and other minerals from beneath the seas. The invention likewise relates to wells used to inject water or hydrocarbon gases into subterranean hydrocarbon reservoirs.

Bottom-supported, permanent surface installations have, in the past, proven to be economically and technologically feasible in comparatively shallow waters to recover hydrocarbon fluids from subaqueous formations. In deeper waters, such as several hundred to several thousand meters, utilization of such surface installations must be limited to very special situations. Installations extending above the water surface are disadvantageous, even in shallower water, where there are adverse surface conditions, such as ice loading.

Recent developments in the offshore oil and gas industry extend production to more undersea areas, such as the outer fringes of the continental shelves and the continental slopes, utilizing a system of submerged, template-drilled wellheads and a submerged well completion system. Subsea systems are feasible for installing multiple wellheads in relatively close proximity through the use of a drilling template secured on the marine floor. Such systems can be operated from remote, floating surface facilities using electrohydraulic control systems, with the subsea systems being connected to the surface facilities by flowlines for production fluids, injection fluids, hydraulic controls, electric cable, and the like.

Habitable, subsea atmospheric work enclosures, or satellites, can be maintained adjacent to multiple, template-drilled wellheads for housing operating and/or maintenance personnel, as disclosed, for example, in U.S. Pat. No. 3,556,208 (Dean). In such systems, the subsea satellite is independently connected to a number of surrounding subsea wellheads and serves to control the production from, and maintenance of, the wellheads. The wells are drilled in a circular pattern through a template on the marine floor, the template serving also as a base upon which the satellite is installed. The production/control passages of each of the wells are connected to production equipment such as a manifold within the satellite by separate wellhead connection assemblies which are independently lowered into place from a surface vessel and form portions of the flow paths between the wellheads and the production manifold within the satellite.

While the aforementioned subsea satellite systems prove generally satisfactory in water depths of about 100 to 150 meters, the use of such systems at depths on the order of 300 to 750 meters presents certain problems. For example, the utilization of guidelines and diver assistance for subsea installation of the components of the system becomes more complex with increasing water depths. In waters of such substantial depth, it becomes necessary to employ dynamic guidance systems, including remote television and/or sonar monitoring, during the installation process. Also, subsea installation of wellhead connection assemblies in prior art well completion systems presents problems in terms of guidance of the assemblies into operative position between the wellhead and the satellite, particularly at water depths approaching 750 meters. Furthermore, prior art subsea well completion systems typically utilize submerged satellite hulls having vertically arranged hull penetrators to provide fluid access to the interior of the satellite. Such an arrangement of penetrators produces undesirable hull stress conditions, particularly at depths in excess of 150 meters.

Additionally, prior art subsea wellhead connection assemblies are typically of such a large size that they are difficult to handle during subsea installation and are vulnerable to damage both during and after installation. Prior assemblies having a curved flowline loop projecting up from the top of the satellite are particularly susceptible to damage.

It is an objective of the present invention to overcome the problems and disadvantages of the prior art by providing an improved subsea wellhead connection assembly significantly reduced in size and capable of simplified installation between a subsea wellhead and a subsea atmospheric work enclosure, for establishing fluid communication between the wellhead and a manifold system contained within the subsea work enclosure. It is a further objective of the present invention to provide improved structural protection for wellhead connection assemblies and the subsea work enclosure.

Additional objectives and advantages of the invention will be set forth in part in the description which follows, and in part will be obvious from the description, or may be learned by practice of the invention. The objectives and advantages of the invention will be realized and attained by means of the instrumentalities and combinations particularly pointed out in the appended claims.

To achieve the objectives and in accordance with the purposes of the invention, as embodied and broadly described herein, the invention comprises a subsea wellhead connection assembly for establishing fluid communication and production capability between a subsea wellhead and an adjacent subsea manifold system, comprising: (1) conduit means for fluidly connecting the wellhead and the manifold system, the conduit means having one end extending substantially horizontally and the other end situated below the horizontal end; (2) wellhead connector means fluidly connected to said other end of the conduit means for releasably connecting the conduit means to the wellhead upon downward movement of the assembly to establish fluid communication therebetween; (3) manifold system connector means fluidly connected to the horizontal end of the conduit means for releasably connecting the conduit means to the manifold system upon lateral movement of the manifold system connector means to establish fluid communication therebetween; and (4) a guide frame rigidly secured to the wellhead connector means for supporting the manifold system connector means and the conduit means, and for vertically aligning the wellhead connector means over the wellhead and horizontally aligning the manifold system connector means with the manifold system.

The invention additionally comprises a subsea wellhead connection assembly for establishing fluid communication and production capability between a manifold system situated within a subsea work enclosure and an adjacent subsea wellhead located in a generally wedge-shaped well bay, comprising: (1) conduit means for fluidly connecting the wellhead and the manifold system, the conduit means having one end extending substantially horizontally and the other end extending downwardly; (2) wellhead connector means fluidly connected to the downwardly directed end of the conduit means for releasably connecting the conduit means to the wellhead upon downward movement of the assembly to establish fluid communication therebetween; (3) manifold system connector means fluidly connected to the horizontal end of the conduit means for releasably connecting the conduit means to the manifold system upon lateral movement of the manifold system connector means to establish fluid communication therebetween; and (4) a guide frame rigidly secured to the wellhead connector means for supporting the manifold system connector means and the conduit means, and for vertically orienting the wellhead connector means over the wellhead and horizontally aligning the manifold system connector means with the manifold system, wherein two opposing sides of the guide frame are wedge-shaped similarly to the wedge-shaped well bay for providing the desired orientation and alignment of the wellhead connection assembly as it is moved laterally during its installation over the wellhead.

The wellhead connection assembly of the present invention, as further embodied and described herein, comprises a subsea wellhead connection assembly for establishing fluid communication and production capability between a subsea wellhead and an adjacent subsea atmospheric manifold system and for establishing fluid communication between the wellhead and a connector mandrel, comprising: (1) first conduit means curved in a loop traversing at least about one full turn for fluidly connecting the wellhead and the manifold system, the first conduit means having one end extending substantially horizontally and the other end situated below the horizontal end; (2) wellhead connector means fluidly connected to said other end of the first conduit means for releasably connecting the first conduit means to the wellhead upon downward movement of the assembly to establish fluid communication therebetween; (3) manifold system connector means fluidly connected to the horizontal end of the first conduit means for releasably connecting the first conduit means to the manifold system upon lateral movement of the manifold system connector means to establish fluid communication therebetween, the manifold system connector means having a pair of guide pins extending substantially horizontally from opposing sides of the connector means to permit alignment during horizontal movement of said manifold system connector means; (4) substantially vertically extending second conduit means having a downwardly directed end fluidly connected to the wellhead connector means and an upwardly directed end fluidly connected to the connector mandrel for establishing fluid communication between the wellhead and the mandrel independent of the manifold system connector means; (5) a protective guide frame comprised of rigid structural piping for supporting and surrounding the manifold system connector means and the first and second conduit means, and for vertically aligning the wellhead connector means over the wellhead and horizontally aligning the manifold system connector means with the manifold system, the guide frame comprising upper and lower support members having substantially identical outer peripheries, when viewed from above, and vertical tubular members rigidly connected between the upper and lower support members, the lower support member being rigidly attached to the wellhead connector means and the upper support member being rigidly attached to the upwardly directed end of the second conduit means; (6) mechanical linkage means supported by the guide frame and having a lever arm having one end attached to the manifold system connector means for laterally moving the manifold system connector means into operative connection with the manifold system, and for reversing such operation to disconnect, the mechanical linkage means preferably having an actuating member pivotally connected to the lever arm, the actuating member having its free end extending substantially vertically upward; and (7) a pair of substantially oppositely facing guide plates rigidly attached to at least one of the vertical members of the guide frame, each guide plate having a slot for supporting and guiding the respective manifold system connector guide pins during lateral movement of the manifold system connector means, the guide pins, guide plates and slots being relatively situated so as to align the manifold system connector means with the manifold system.

As embodied and broadly described herein, the invention further comprises a method of establishing fluid communication and production capability between a marine floor wellhead and an adjacent subsea manifold system, comprising the steps of: (1) providing a wellhead connection assembly comprising conduit means for fluidly connecting the wellhead and the manifold system, the conduit means having one end extending substantially horizontally and the other end situated below the horizontal end, wellhead connector means fluidly connected to said other end of the conduit means, manifold system connector means fluidly connected to the horizontal end of the conduit means, and a guide frame rigidly secured to the wellhead connector means for supporting the manifold system connector means and the conduit means; (2) lowering the wellhead connection assembly; (3) vertically aligning the wellhead connector means over the wellhead and horizontally aligning the manifold system connector means with the manifold system; (4) releasably connecting the wellhead connector means to the wellhead, thereby establishing fluid communication between the wellhead and the conduit means; and (5) then horizontally moving the manifold system connector into operative connection with the manifold system, thereby establishing fluid communication between the conduit means and the manifold system.

The accompanying drawings, which are incorporated in and constitute a part of this specification, illustrate exemplary embodiments of the invention and, together with the description, serve to explain the principles of the invention.

THE DRAWINGS

DESCRIPTION OF PREFERRED EMBODIMENTS

Reference will now be made in detail to the presently preferred embodiments of the invention, examples of which are illustrated in the accompanying drawings.

Figure 1:
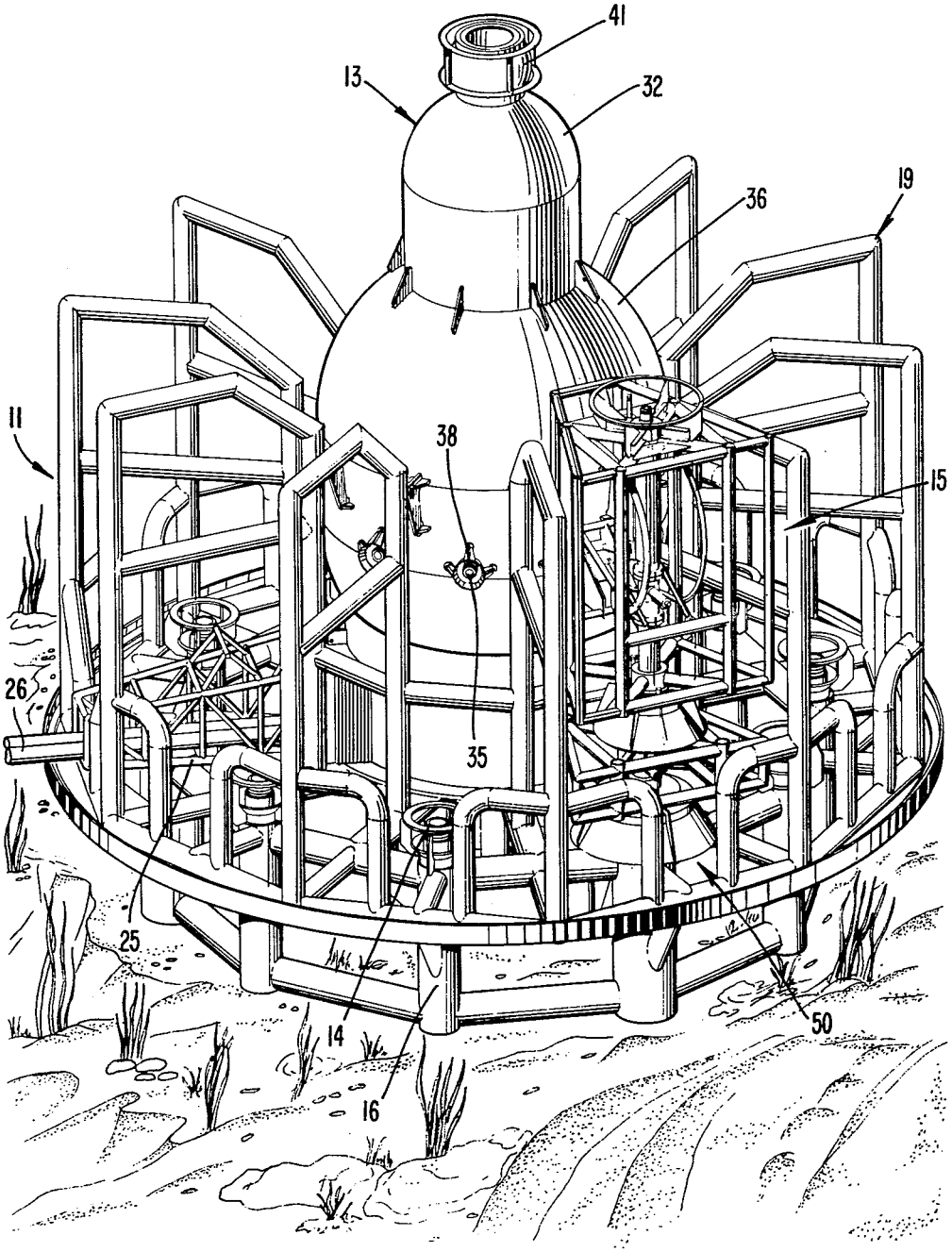
FIG. 1 is a perspective view of a subsea well completion system utilizing the improved wellhead connection assembly of the present invention.
Figure 2:
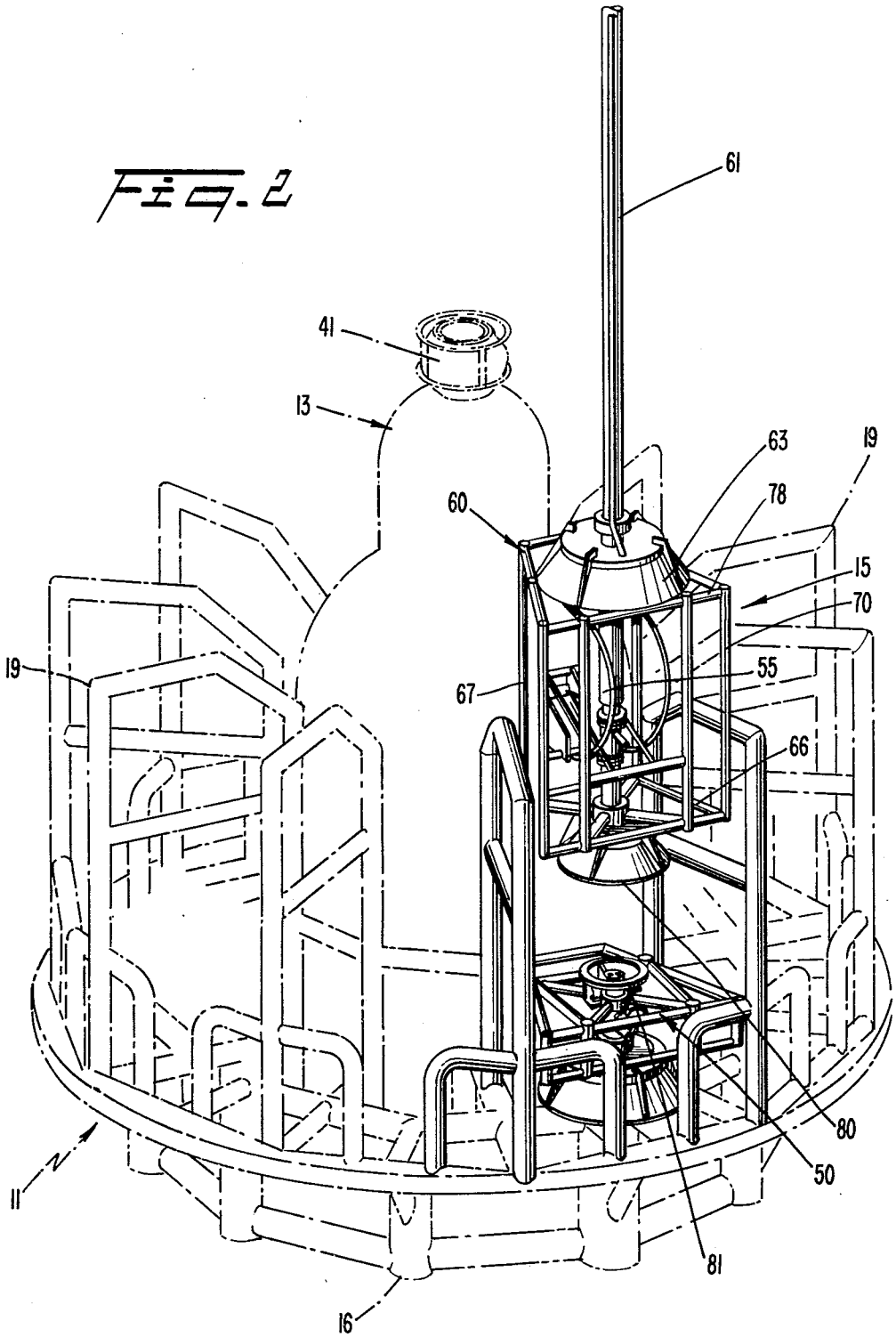
FIG. 2 is a perspective view of a subsea well completion system, in partial phantom, showing guidelineless installation of the wellhead connection assembly of the present invention.

One preferred embodiment of the subsea wellhead connection assembly is shown in FIGS. 1–5, and is represented generally by the numeral 15. To facilitate an understanding of the structure and functioning of the wellhead connection assembly of the present invention, the overall subsea well completion system, of which the invention is but one component, will first be briefly described. Such a well completion system, as illustrated in FIGS. 1 and 2, typically includes a base template, designated generally by the numeral 11, having a lower support structure for supporting a work enclosure hull 13, individual wellheads 14, and wellhead connection assembly 15. Conventional wellheads 14 are mounted on well conductor pipes 16, also of conventional design, which form a portion of the lower support structure of base template 11.

A semisubmersible drilling rig or moored vessel (not shown) lowers base template 11 to the marine floor in a known manner. Drilling of each well through the base template is accomplished using a conventional blow out preventer (BOP) stack and conventional drilling procedures. When a well is completed, a master valve assembly 50 preferably is lowered by a drilling riser (not shown) and operatively connected to a wellhead to cap it. The work enclosure hull is also installed on the base template by lowering it on a riser from a semisubmersible drilling vessel or via a wire rope system from a construction barge.

In accordance with the present invention, wellhead connection assemblies are then lowered from the drilling rig on a drilling or completion riser, or drill pipe, and operatively connected between each master valve assembly and a manifold housed within an atmospheric work enclosure hull through penetrators which preferably extend horizontally through the exterior of the hull. The manifold and penetrators form a manifold system. The manifold system, in turn, connects to pipelines and flowlines extending through the work enclosure hull.

The well completion system is operated from a remote surface production facility through the use of conventional electrohydraulic control systems, with the well completion system being connected to the surface facility by pipelines, fluid service lines, hydraulic lines, and electric cables. Production and control equipment inside work enclosure hull 13 is maintained by personnel brought to the control section 32 of hull 13 in a submersible or tethered vehicle (not shown) and transferred through transfer "trunk" or "teacup" 41 using conventional dry transfer techniques. Well repair is performed either by vertical reentry techniques from a floating drilling rig, or through the use of conventional pump-down tools (PDT) launched from inside the work enclosure hull and controlled from the remote surface facility.

Where desirable, e.g. for deeper water applications, all subsea components of the well completion system are installed on the base template without the use of guidelines. A preferred guidelineless well completion system, with one wellhead connection assembly and one master valve assembly installed, or being installed, in accordance with the present invention is shown in FIGS. 1 and 2.

Base template 11 typically includes an upper guidance structure comprised of a plurality of substantially vertically extending guide members 19 mounted on the template in spaced radial array. Each vertical guide member 19 extends inwardly from the outer periphery of the base template along a radially aligned plane. While other shapes are possible, base template 11 is preferably circular in shape, when viewed from above, with wellheads 14 and well conductor pipes 16 spaced about its circumference, preferably at a common radial distance from the center of the template. In such a system, vertical guide members 19 are preferably spaced apart equidistantly.

Spaced about the periphery of work enclosure hull 13, and extending generally horizontally therefrom, are horizontally aligned penetrators 35 for establishing well fluid communication through work enclosure hull 13. Horizontal alignment of penetrators 35 through hull 13 provides improved hull stress relief.

Figure 6:
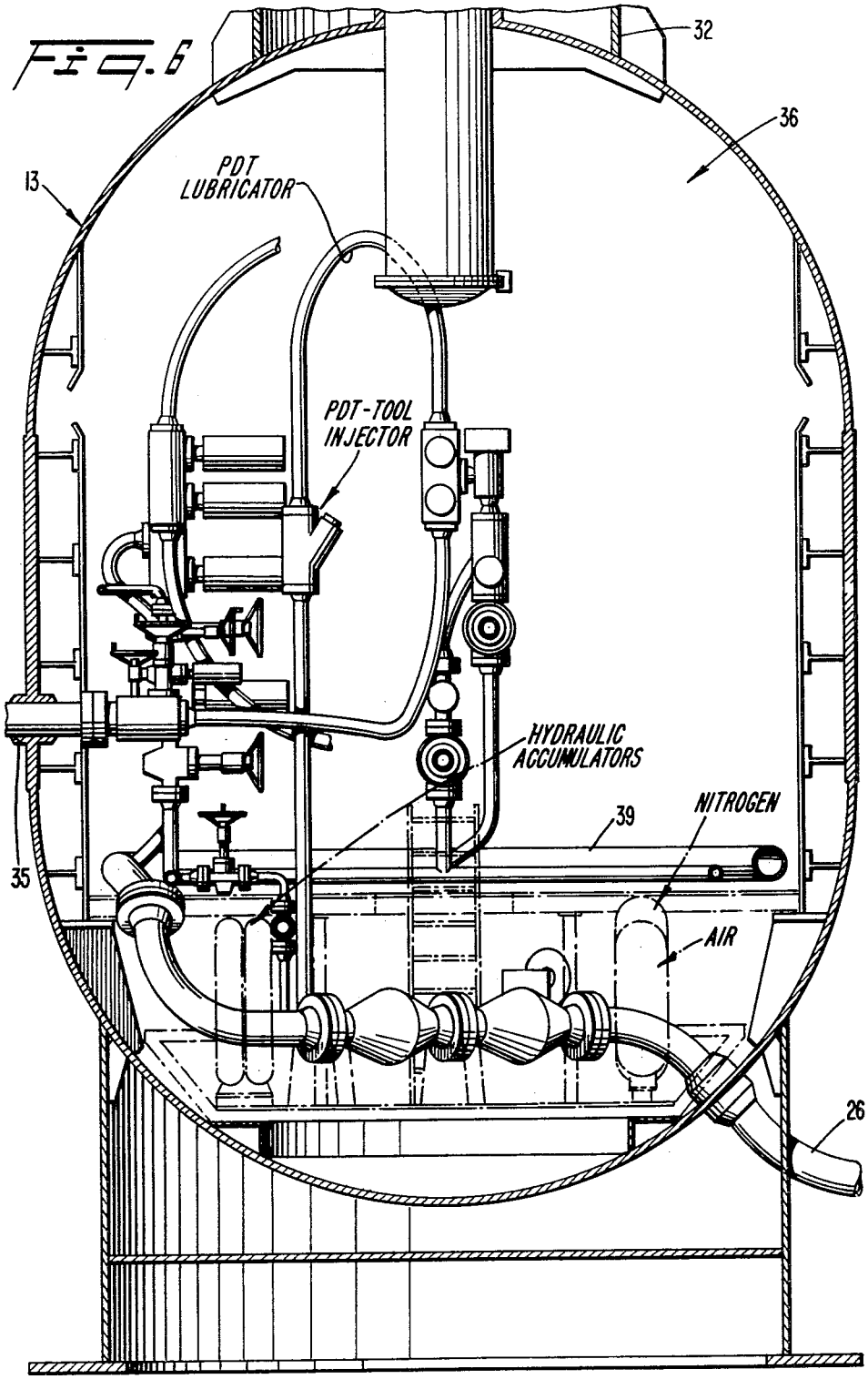
FIG. 6 is a cross-sectional side elevation view of the lower service section of a subsea work enclosure hull, showing a portion of the internal fluid handling apparatus.

Work enclosure hull 13 houses production manifold 39 (FIG. 6), which is operatively connected to one or more pipelines 26 extending through the hull 13. A portion of the internal fluid handling system within a typical service section 36 of work enclosure hull 13, as shown in FIG. 6, provides for operatively connecting the internal terminations of penetrators 35 to manifold 39. Preferably, penetrators 35 are integrally welded to work enclosure hull 13. Various produced petroleum streams, gas streams, water streams, chemical injection streams, test streams and hydraulic lines can be manifolded through their respective lines and valves, individually, according to the desired production schedules. The manifolding and valving are preferably designed to permit the passage of conventional pump-down tools (PDT) from the subsea work enclosure hull out to and down the individual wells. Capability will typically be provided to switch the individual well function (from production to test to service) during the operating life of the well, if necessary. Internal valves permit sequencing or combining fluids according to the desired production schedules. Remotely-actuated and/or manual valve operations are employed, as desired.

FIG. 6 illustrates various portions of a typical system of internal piping and valving, including PDT capability, for establishing fluid flow between a single penetrator 35 and manifold 39. For ease of understanding, FIG. 6 shows both front and side views of the same system. Substantially identical systems are provided for connecting each of the individual penetrators 35 spaced about work enclosure hull 13 to manifold 39. The complete details of such other systems have been omitted from FIG. 6 for clarity. PDT servicing requires that at least a 1.52 meter bending radius be maintained on all piping bends through which pump-down tools will pass.

Referring now to FIGS. 1-5, a well completion system further preferably comprises a wellhead connection assembly 15 in accordance with the present invention for establishing fluid communication and production capability between a subsea wellhead system and an adjacent subsea atmospheric manifold system.

The wellhead connection assembly 15 of the present invention comprises: (1) conduit means, illustratively shown as conduit 42, for fluidly connecting wellhead 14 and a manifold system comprised of manifold means, illustratively shown as manifold 39, and horizontal penetrator 35, conduit 42 having one end 43 extending substantially horizontally and the other end 44 situated below the horizontal end; (2) wellhead connector means, illustratively shown as wellhead connector 45 (FIG. 4), connected for fluid flow to end 44 of conduit 42 for releasably connecting conduit 42 to wellhead 14 upon downward movement of assembly 15 to establish fluid communication therebetween; (3) manifold system connector means (also referred to herein as penetrator connector means), illustratively shown as manifold system connector 56, fluidly connected to horizontal end 43 of conduit 42 for releasably connecting conduit 42 to penetrator 35 upon lateral movement of manifold system connector 56 to establish fluid communication therebetween; and (4) a guide frame 60 rigidly secured to wellhead connector 45 for supporting manifold system connector 56 and conduit 42, and for vertically aligning wellhead connector 45 directly over wellhead 14 and horizontally aligning manifold system connector 56 with penetrator 35.

In a preferred embodiment, wellhead connector 45 does not attach directly to wellhead 14, but is connected to a master valve assembly 50, which is secured to wellhead 14 for providing well shut-in capability and protection before the well is connected to manifold 39 within work enclosure hull 13. Master valve assembly 50, which may be of conventional construction, is installed on base template 11 before work enclosure hull 13 is installed.

Figure 7:
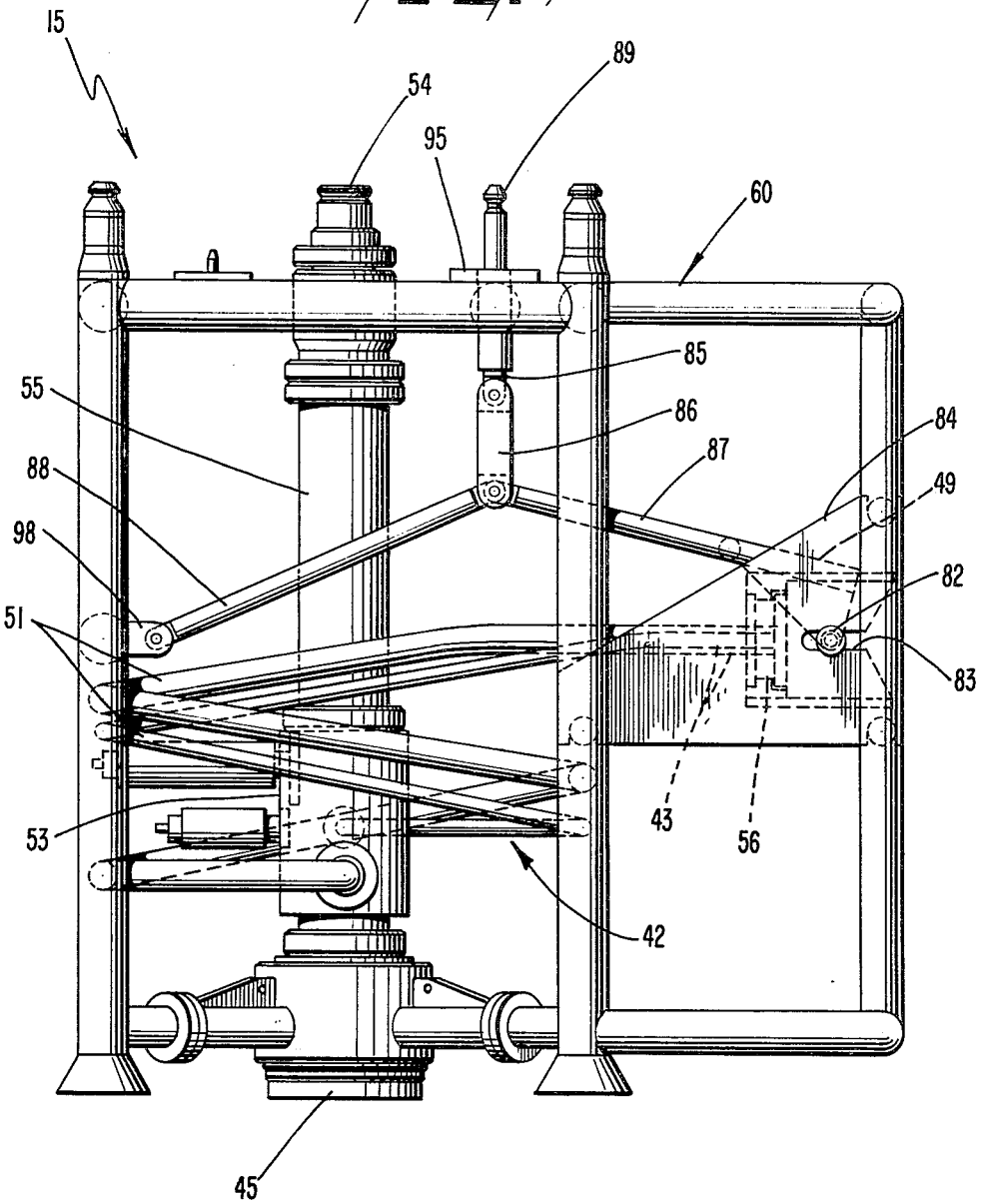
FIG. 7 is a side elevation view of another preferred embodiment of the wellhead connection assembly of the present invention.

As embodied herein, conduit 42 comprises at least one, and preferably two or three, conventional flexible flowline loops 51. These loops must be able to flex sufficiently to accommodate the coupling and uncoupling of manifold system connector 56 and horizontal penetrator 35. Additionally, in those preferred embodiments where it is desired to pass conventional pump-down tools down the well, flowline loops 51 must include no bends having a radius less than 1.52 meters, in order to accommodate passage of the tools. We have determined that, for such embodiments, configuration of flowline loops 51 in substantially vertically aligned loops extending about one full turn, as shown in FIGS. 1-5, is preferred. On the other hand, where pump-down tool capability is not required, configuration of flowline loops 51 in substantially horizontally aligned loops extending about one and one-half full turns is preferred. Such an embodiment, which is shown in FIG. 7, does not require a 1.52 meters minimum bending radius for loops 51 and provides a more compact assembly 15. Elements corresponding generally to those shown in the other Figures and discussed elsewhere herein bear identical reference numerals in FIG. 7. Except as otherwise noted, the structure and operation of the embodiment of FIG. 7 is substantially identical to the other embodiments described herein.

As embodied herein, wellhead connector 45 (FIG. 4) comprises a conventional 34.6 cm diameter, $3.45\times10^8$ dynes/cm$^2$ ($6.9\times10^8$ dynes/cm$^2$ for gas injection wells) hydraulically operated (lock and unlock) subsea, wellhead connector with a 34.6 cm diameter, $3.45\times10^8$ dynes/cm$^2$ ($6.9\times10^8$ dynes/cm$^2$) studded top for establishing operative fluid communication between wellhead 14, or master valve assembly 50 as the case may be, and the downwardly extending end 44 of conduit 42. A conventional mechanical override release system can be incorporated in wellhead connector 45 if desired. The production flowlines and electro-hydraulic control lines (not shown) in wellhead 14 (or master valve assembly 50) interface with corresponding production passages and electro-hydraulic control passages (not shown) extending through wellhead connector 45 and flowlines 51 using conventional subsea male and female mating stab plates (not shown) mounted on the top of wellhead 14 (or master valve assembly 50) and the bottom of connector 45. Conventional techniques for establishing the operative connections, commonly referred to as "stabbing over," may be used.

Figure 3:
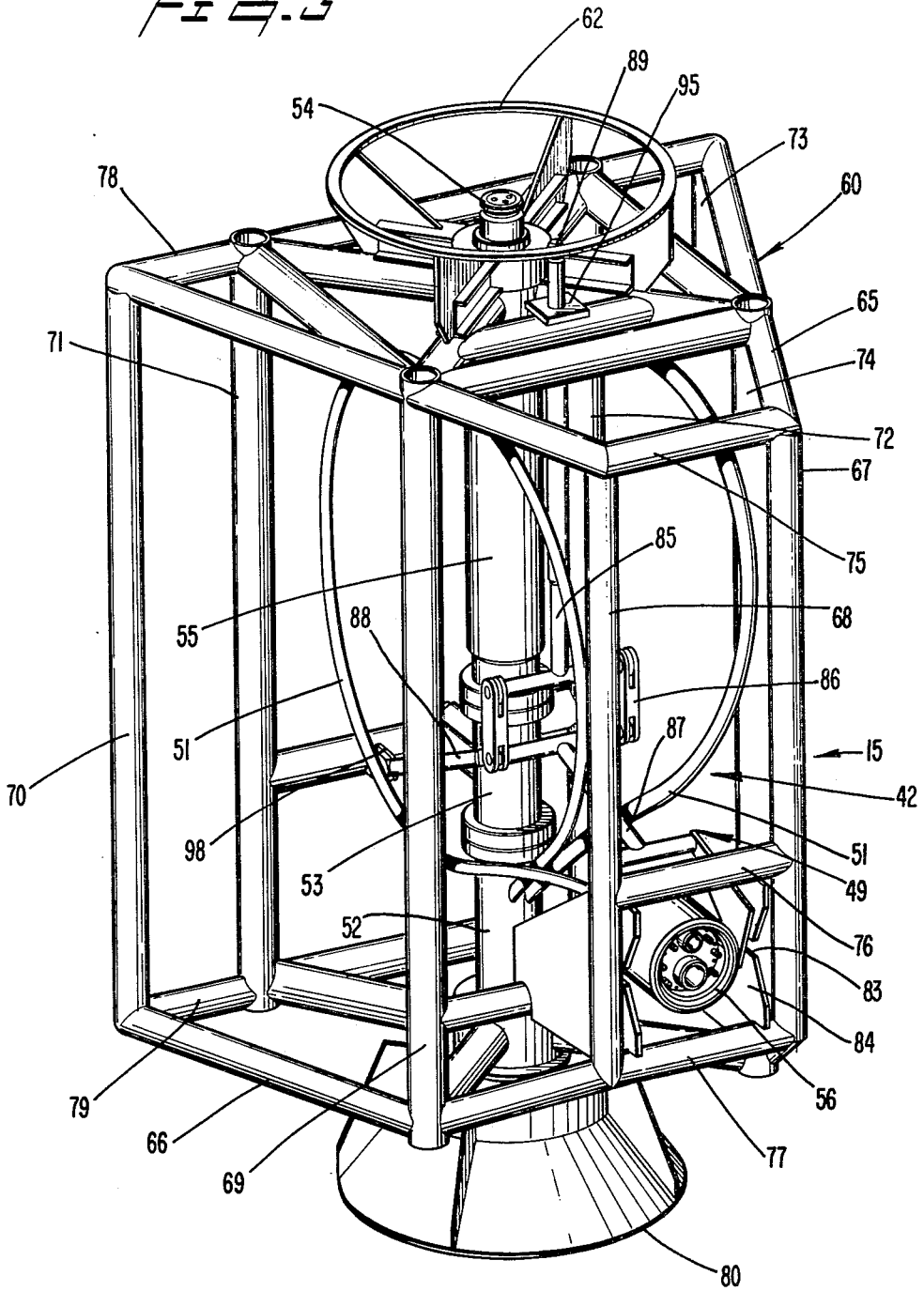
FIG. 3 is a perspective view of the improved wellhead connection assembly of the present invention.
Figure 4:
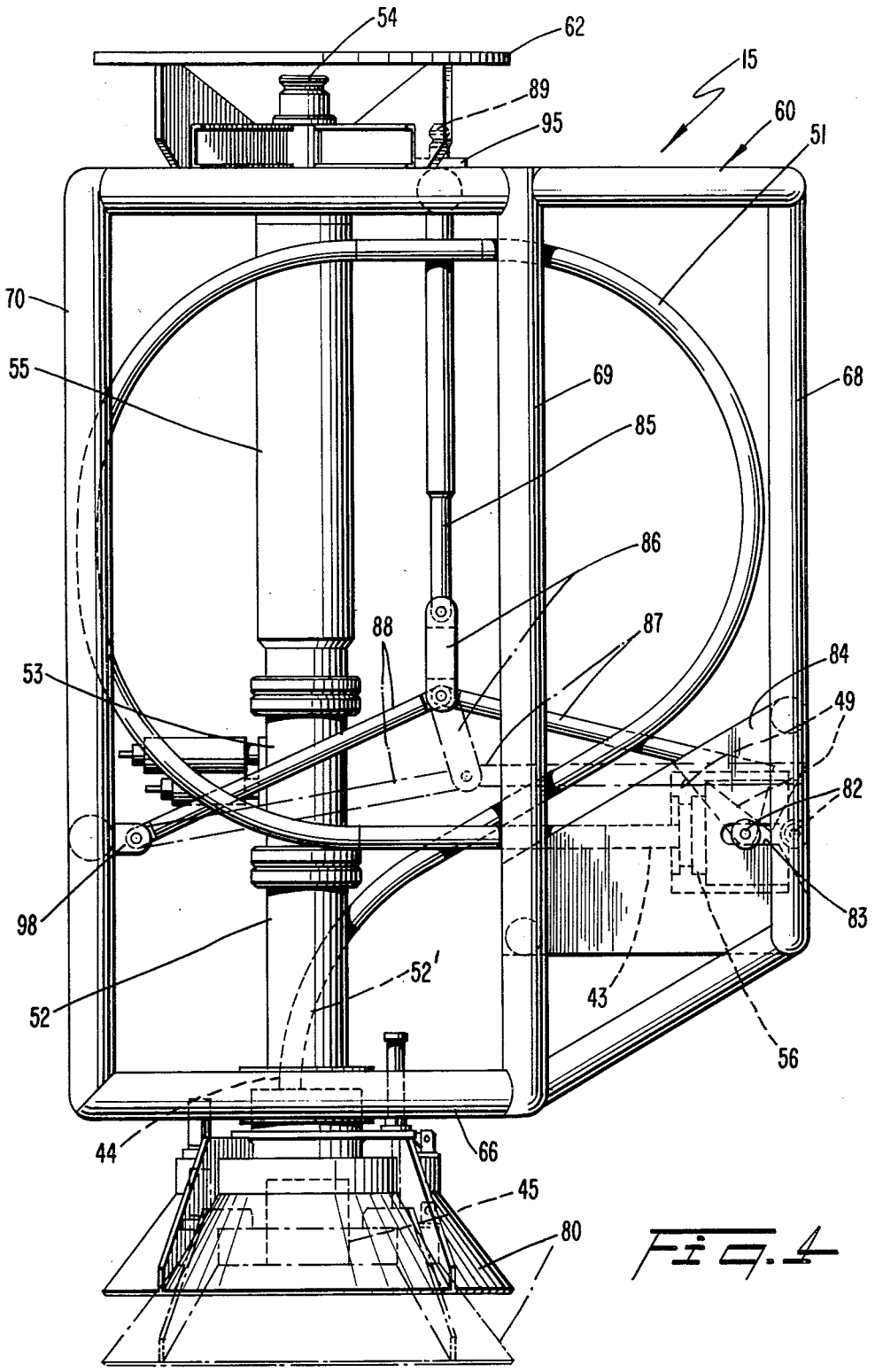
FIG. 4 is a side elevation view, in partial phantom, of the wellhead connection assembly shown in FIG. 3.
Figure 5:
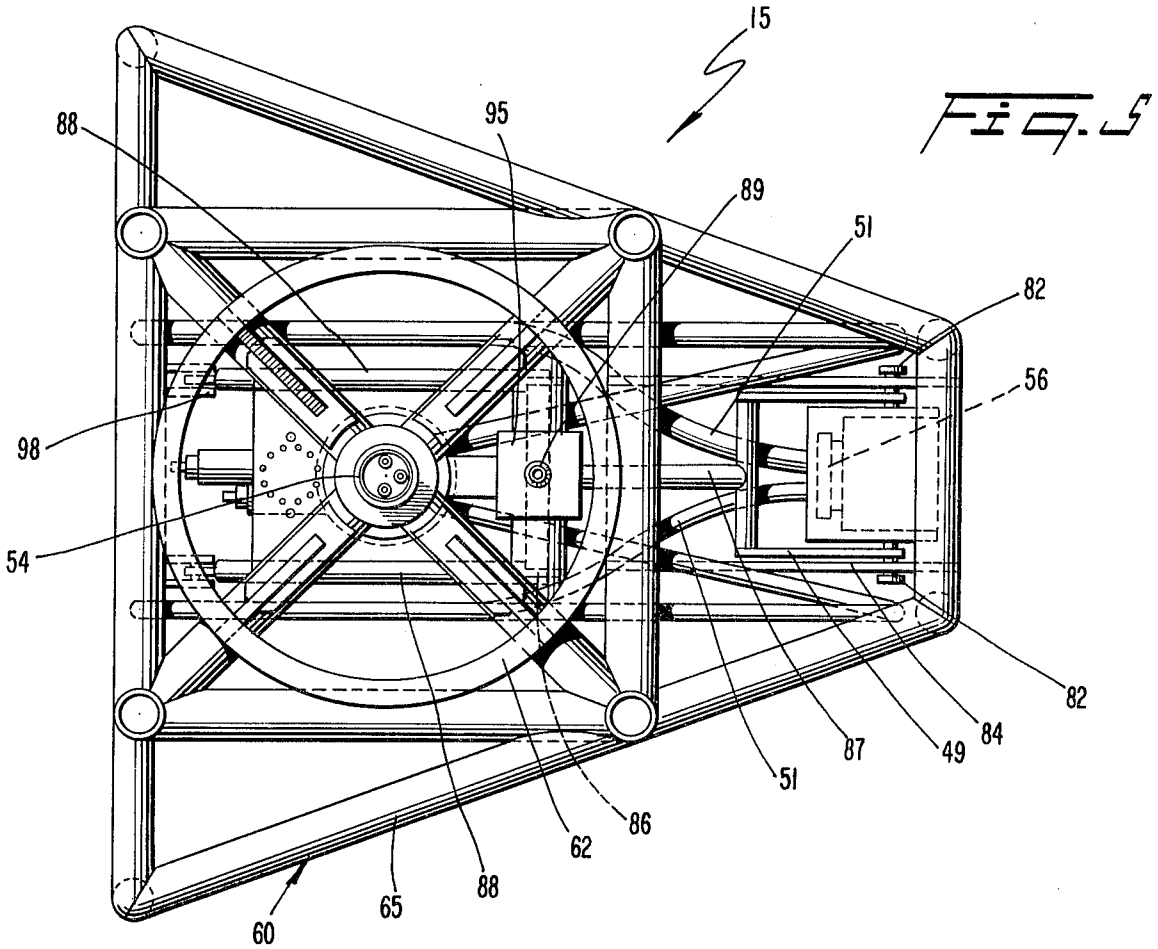
FIG. 5 is a plan view of the wellhead connection assembly shown in FIG. 3.

As further embodied herein, and as best shown in FIGS. 3, 4, & 5, manifold system connector 56 comprises a conventional horizontal flowline connector for establishing operative fluid communication between subsea atmospheric manifold system penetrator 35 and the horizontally extending end 43 of conduit 42. For a more complete description of the construction and operation of one suitable conventional manifold system connector 56 and penetrator 35, attention is invited to U.S. Pat. No. 4,191,256 (Croy), which is hereby specifically incorporated by reference.

Preferably, manifold system connector 56 and penetrator 35 are designed to permit the use of the smallest possible penetration through subsea work enclosure hull 13, and are mechanically extended and hydraulically locked and unlocked.

Manifold system connector 56 is preferably mounted in a yoke 49 having pins 82 extending laterally from its opposite ends. Pins 82 are supported in substantially horizontal slots 83 in guide plates 84 secured to guide frame 60. Manifold system connector 56 is preferably laterally moved into operative connection with penetrator 35 through the use of mechanical linkage means, illustratively shown as a mechanical linkage comprising actuating rod 85, plate 95, link member 86, lever arm 87, follower support rods 88, and support pivot 98.

As embodied herein, the mechanical linkage is constructed so that manifold system connector 56 is laterally moved by downward movement of a vertically aligned actuating rod 85 which is supported by plate 95 attached to the top portion of guide frame 60, which downward movement is translated into lateral movement by a link member 86 pivotally connected between the lower end of actuating rod 85 and a lever arm 87 attached to yoke 49, and by the sliding of pins 82 along slots 83. Similarly, upward movement of actuating rod 85 retracts manifold system connector 56 from contact with penetrator 35. When manifold system connector 56 is stroked forward, it leaves guide plate slots 83, but not before engaging penetrator 35. Guide cone 38 is rigidly secured to the exterior of work enclosure hull 13 and extends generally concentrically about the center of penetrator 35. Guide cone 38 can be used to provide the proper axial and horizontal alignment between connector 56 and penetrator 35, with a plus or minus 3.8 cm omnidirectional tolerance. Preferably, a receptacle (not shown) is provided on penetrator 35 for engaging a guide pin (not shown) provided in connector 56 for fine orientation of multiple conventional bore stabs in connector 56 with corresponding multiple conventional bores in penetrator 35.

Follower support rods 88 have one end pivotally connected to link member 86 and the other end pivotally mounted on support pivot 98 secured to guide frame 60 for supporting and positioning link member 86.

FIG. 4 illustrates the relative positioning of link member 86, lever arm 87, follower rod 88, yoke 49, and pins 82 for both the retracted case (solid lines) and the extended or stroked case (dashed lines). Such a configuration of elements provides a significant leverage advantage, so that manifold system connector 56 can be operated by a small input force applied to actuating rod 85. Preferably, such an input force is hydraulically applied to rod 85 by a conventional running tool (not shown) which releasably connects to rod end 89 which preferably extends upwardly from the top of guide frame 60 and is supported by plate 95 secured to the guide frame. Preferably, the running tool is releasably secured to the top of guide frame 60 during installation of wellhead connection assembly 15 on wellhead 14 or master valve assembly 50. Once manifold system connector 56 is in the proper position, it is preferably hydraulically locked to penetrator 35 by pressuring through the running tool in a conventional manner.

Conventional electro-hydraulic controls extend from the running tool to a remote surface facility in a known manner.

Preferably, conventional hydraulic control stab plates are located at both the top and bottom of wellhead connection assembly 15 (e.g., in connector mandrel 54 and wellhead connector 45, respectively) for engaging the running tool and the wellhead (or the master valve assembly), respectively, in a conventionally known manner. Multiple control lines from manifold system connector 56 are preferably plumbed directly to the upper stab plate.

After manifold system connector 56 is locked to penetrator 35, a conventional crossover manifold cap (not shown) is preferably lowered and fluidly locked to wellhead connection assembly connector mandrel 54. The crossover cap serves to protect the mandrel 54 profile and seal pockets in mandrel 54 from falling debris. It also provides a means for providing fluid connection/manifolding of the hydraulic control lines (not shown) between work enclosure hull 13 and wellhead 14. These lines pass through manifold system connector 56, along flowlines 51, wye spool 52 (if present), swab valve block 53 and spacer spool 55 to the crossover cap, and then back down through spacer spool 55, along swab valve block 53 and wye spool 52 to master valve assembly 50 (if present), and through wellhead 14 into the well bore so that each of the above-enumerated components/functions can be accessed and actuated from the submerged work enclosure hull 13 or the running tool without the need for shuttle valves, and so that, upon disconnection of the running tool from wellhead connection assembly 15, and the installation of a crossover cap, each of these components/functions can be accessed and actuated from submerged work enclosure hull 13.

The above-described procedures are followed for each of the wellhead connection assemblies 15 to be installed.

Wellhead connection assembly 15 also preferably includes a wye spool 52 having vertical through bores (not shown) which are intersected by curved bores 52' (FIG. 4), which exit through the side of spool 52. The vertical bores preferably have a profile adapted to accept a conventional wireline retrievable diverter (not shown), and are fluidly connected at their lower ends to wellhead connector 45. Curved bores 52' are fluidly connected to the lower ends of flowlines 51, and have substantially vertically extending lower end portions forming the vertically extending end 44 of conduit 42. In order to provide for pump-down tool capability, if desired, the bores 52' of wye spool 52 must be curved on a radius of at least 1.52 meters.

A conventional swab valve block 53 is preferably included in wellhead connection assembly 15 for maintenance purposes, commonly referred to as "workover." In the preferred embodiment shown in FIGS. 1–5, swab valve block 53, is fluidly connected at the top of wye spool 52 so that it may be vertically accessed from the surface or a submersible work vehicle via conventional connector mandrel 54 and tubular spacer spool 55 which are rigidly attached to guide frame 60 and connected in fluid flow relationship with swab valve block 53.

Together, wye spool 52, with or without a diverter, swab valve block 53, spacer spool 55 and, optionally, connector mandrel 54 provide an illustrative example of a wellhead re-entry conduit means for establishing fluid communication with the wellhead independently of manifold system connector 56.

Upon coupling wellhead connector 45 to wellhead 14, or master valve assembly 50, and coupling manifold system connector 56 to lateral penetrator 35, well fluids exiting wellhead 14 may be communicated through work enclosure hull 13 and into manifold 39, thus establishing production capability. The wellhead connection assembly of the present invention, as described above, is significantly reduced in size when compared with prior structures, while still providing external production piping which is removable for maintenance.

Figure 9:
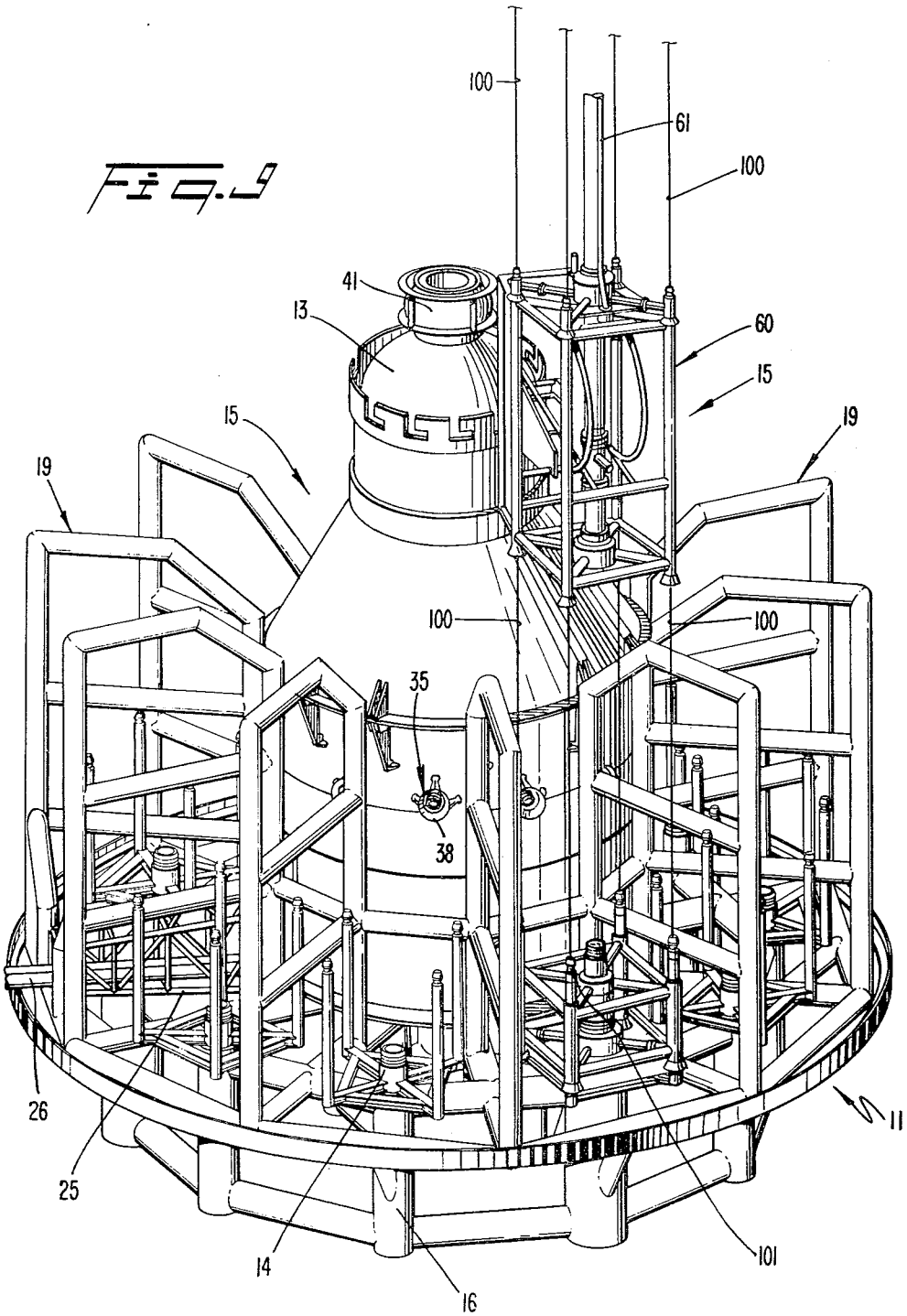
FIG. 9 is a perspective view of a subsea well completion system showing guideline installation of the wellhead connection assembly illustrated in FIG. 8.

As indicated, wellhead connection assembly 15 preferably further comprises a guide frame 60 for support and structural protection. Conduit 42, wellhead connector 45, and manifold system connector 56 are preferably disposed within the confines of guide frame 60 for structural protection. Preferably, the horizontal peripheries defined by the top and bottom of guide frame 60, when viewed from above, are substantially identical. As shown in FIGS. 2 and 9, wellhead connection assembly 15 may be installed on base template 11 by lowering it on a riser 61 connected to upper mandrel 54 by a conventional running tool using guidelineless installation techniques (FIG. 2) or conventional guideline assisted techniques (FIG. 9). In water depths on the order of 750 meters, conventional guideline installation may, however, not be practical. Consequently, in one preferred embodiment of the invention (FIGS. 1–5), a specially-designed guide frame 60 serves not only as a protective cage, but also facilitates guidelineless installation of wellhead connection assembly 15 on wellhead 14 and adjacent to penetrator 35.

Specifically, in the preferred embodiment shown in FIGS. 1–5, guide frame 60 is constructed as an open, wedge-shaped bumper structure designed to mate with a well bay defined by adjacent vertical dividers/guides 19 of base template 11 for facilitating coarse alignment and orientation of wellhead connection assembly 15 on wellhead 14. The well bay may be defined by any vertical dividers 19 suitably constructed for protecting and aligning wellhead connection assembly 15. Thus, it is not essential that the dividers comprise a part of base template 11. Preferably, dividers 19 are rigidly attached to wellhead 14. The bumper structure of guide frame 60 preferably extends the full height of assembly 15, and is preferably comprised of extra-heavy structural piping.

In the preferred embodiment shown in FIGS. 1–5, guide frame 60 comprises top and bottom support members 65, 66 having substantially identical outer peripheries (when viewed from above), with manifold system connector 56 aligned for inward, substantially horizontal connection to a mating horizontal penetrator 35 on work enclosure hull 13, and wellhead connector 45 aligned for downward connection to a mating wellhead 14, either directly or via a master valve assembly 50. Top and bottom support members 65, 66 are connected by open, substantially vertical structural members 67, 68, 69, 70, 71, 72, 73, 74, and have an inwardly-tapering outer dimension to facilitate alignment of guide frame 60 within a correspondingly tapered well bay section. Although the trapezoidal shape of top and bottom support members 65, 66 shown in FIGS. 1–5 is well-suited to provide the desired inwardly-tapering outer dimension of guide frame 60, it is by no means the only suitable shape. The important factor is that guide frame 60 have opposing side portions which are tapered similarly to the tapered sides of the well bay in which wellhead connection assembly 15 is to be mounted (as defined by adjacent vertical guide members 19), and which are sufficiently spaced apart and extend for a sufficient length and height to provide alignment of guide frame 60 in the well bay as it is moved laterally inwardly during installation.

It is likewise important that the tapered side portions of guide frame 60 taper to a narrow end width which is sufficiently narrow to permit the guide frame to fully enter the well bay, and thus position wellhead connection assembly 15, and particularly manifold system connector 56, sufficiently close to work enclosure hull 13, and particularly to penetrator 35, to permit their operative connection. Thus, the width of the narrow end of guide frame 60 must not be so large that during lateral movement of the guide frame toward manifold system penetrator 35 during installation, the guide frame becomes wedged between adjacent guide members 19 at a distance from penetrator 35 which will preclude connection of manifold system connector 56 and penetrator 35 in fluid flow relationship.

As an alternative to the tapering, or wedge-shaped, guide frame 60, the desired orientation of wellhead connection assembly 15 in the well bay may be achieved by making the width dimension of the radially outermost portion of guide frame 60, with respect to the center of base template 11, sufficiently large to prevent misorientation of guide frame 60. In the embodiment shown in FIG. 3, this width dimension is defined by bumper members 78, 79. In such an alternative construction, radial positioning of wellhead connection assembly 15 is preferably assisted by making the width dimension of the radially innermost portion of guide frame 60 (defined by end bumper members 75, 76, 77 in FIG. 3) sufficiently small so as not to become wedged between vertical guides 19 at too great a distance from manifold system penetrator 35 to achieve operative connection with manifold system connector 56, and by proper positioning of the components of assembly 15 on guide frame 60 with respect to their distance from end bumper members 75, 76, 77, which abut against work enclosure hull 13. Bumper member 76 is preferably situated in close proximity to manifold system connector 56 to protect it from being damaged during installation of assembly 15 or by falling debris.

Guidelineless installation of wellhead connection assembly 15 is achieved by first lowering the assembly to a depth which permits contact between guide frame 60 and vertical guide members 19. For safety reasons, assembly 15 is preferably not lowered directly over work enclosure hull 13. This reduces the risk, should the lowering riser fail or a mishap occur, resulting in the equipment being dropped. Having reached the proper depth in the general vicinity of vertical guide members 19, wellhead connection assembly 15 is moved laterally in the general direction of manifold system penetrator 35. Monitoring of its movement may be handled by remote television cameras, sonar, submarines, etc. Guide frame 60 will contact one or more vertical guide members 19 and will be guided into the well bay between adjacent guide members, thus insuring coarse alignment of wellhead connection assembly 15. Preferably, the omnidirectional misalignment of wellhead connector 45 with respect to wellhead 14 is no more than about 30 cm.

Referring again to FIG. 1, in a preferred embodiment of the present invention, vertical guide members 19 are spaced equidistantly around base template 11 so as to divide it into equally-sized, inwardly tapered well bays, all but one of which are adapted to receive correspondingly tapered wellhead connection assemblies 15. As shown, one well bay is adapted to receive pipeline boom 25 which supports and protects pipelines 26 which are fluidly connected to manifold 39 within work enclosure hull 13. Pipelines 26 carry produced well fluids to remote subsea or surface production/collection facilities.

Each of the horizontal penetrators 35 are situated on work enclosure hull 13 so as to be aligned with a wellhead connection assembly 15, with the horizontal spacing between all but two of the lateral penetrators (the penetrators which are on opposite sides of the well bay receiving pipeline boom 25) being equal. Such an arrangement, together with the arrangement of wellheads 14 at a common radial distance from the center of base template 11, permits the use of equally sized and shaped wellhead connection assemblies 15.

Referring now to FIGS. 1, 2 and 4, final (fine) alignment and operative connection of wellhead connection assembly 15 with wellhead 14, or typically with master valve assembly 50 which is coupled to wellhead 14, is preferably achieved using conventional funneling alignment techniques. One such technique employs a large diameter, downwardly directed funnel 80 connected to the bottom of wellhead connector 45 and/or guide frame 60. As wellhead connection assembly 15 is lowered, funnel 80 is guided over a mating alignment structure, e.g. landing ring 81, on master valve assembly 50 and the wellhead connection assembly 15 is rotated into the final, aligned position. Preferably, assembly 15 is finally aligned by rotating it on landing ring 81 until a spring loaded alignment pin (not shown) on funnel 80 engages a slot (not shown) in the ring. Funnel 80 is then retracted upward, allowing wellhead connection assembly 15 to operatively engage the mandrel of master valve assembly 50 (or wellhead 14), thereby establishing fluid communication. In FIG. 4, funnel 80 is shown in both its extended position (dashed lines) and its upwardly retracted position (solid lines).

Such a guide funnel technique may also be used to connect wellhead connection assembly 15 to drilling riser 61, with funnel 63 (FIG. 2) being secured to the riser, or a conventional running tool (not shown), and guided over landing ring 62 on the assembly.

Figure 8:
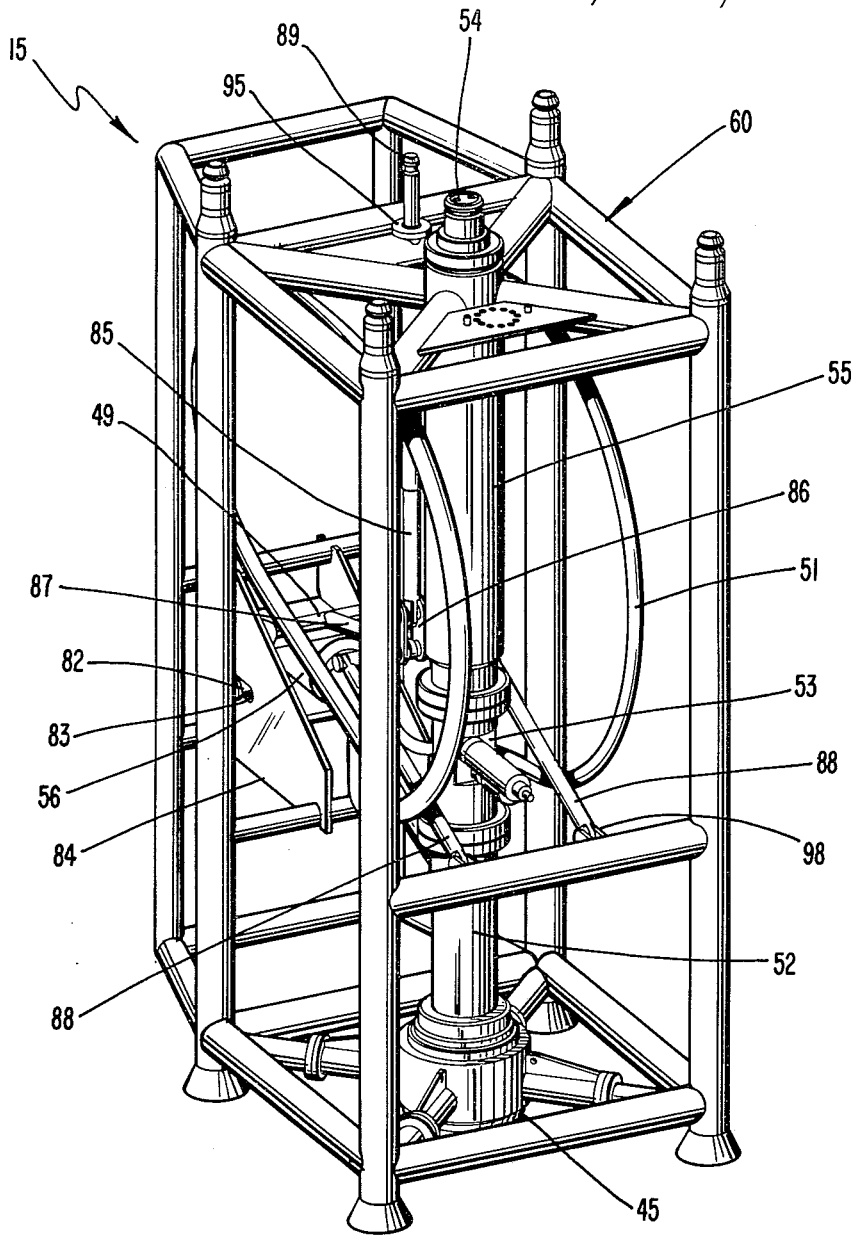
FIG. 8 is a perspective view of a further preferred embodiment of the wellhead connection assembly of the present invention.

FIGS. 7–9 illustrate an embodiment of the invention in which a conventional guideline technique is used for installing wellhead connection assembly 15. In this technique, guidelines 100 are affixed to a guide frame 101 secured in a well bay on base template 11, and are then strung through vertical piping which forms the corner posts of the wellhead connection assembly guide frame 60. The guidelines are placed under high tension. Wellhead connection assembly 15 is lowered along guidelines 100 by a riser 61, with guidelines 100 providing the desired horizontal alignment of manifold system connector 56 and the desired vertical alignment of wellhead connector 45. In such a system, the structure of wellhead connection assembly 15, vertical guide members 19, and base template 11 is essentially as described above for guidelineless installation (except for the presence of guide frame 101). However, embodiments of the invention designed for guideline installation do not require the specially shaped guide frame 60 illustrated in FIGS. 1–5.

Illustrative exemplary parameters for various system components of the present invention are discussed below.

A wellhead connection assembly 15 constructed substantially as illustrated in FIGS. 1–5, designed for installation at water depths on the order of 750 meters, preferably has overall height, length and width dimensions of about 7.5 meters, 4.4 meters, and 4.8 meters, respectively, and a weight of about 18,100 kg in air and 15,800 kg submerged. The horizontal spacing between vertical structural members 69 and 71 (FIG. 3) is preferably about 2.6 meters. A wellhead connection assembly 15 constructed substantially as illustrated in FIG. 7, designed, for example, for installation at water depths on the order of 300 meters, preferably has overall height, length and width dimensions of about 4.9 meters, 4.6 meters, and 3.1 meters, respectively, and a weight of about 13,150 kg in air and 11,450 kg submerged. A wellhead connection assembly 15 constructed substantially as illustrated in FIGS. 8–9, designed, for example, for installation at water depths on the order of 150 meters preferably has overall height, length and width dimensions of about 7.0 meters, 4.6 meters, and 3.1 meters, respectively, and a weight of about 16,800 kg in air and 14,500 kg submerged.

The wellhead connection assembly 15 of the present invention is preferably sized and constructed such that, upon installation of the assembly onto wellhead 14, the horizontal distance from the wellhead to manifold system penetrator 35 is on the order of 3 meters, the omnidirectional misalignment of manifold system connector means 56 with respect to penetrator 35 is no more than about 3.8 cm, and the omnidirectional misalignment of wellhead connector 45 with respect to wellhead 14 is no more than about 30 cm.

Flexible flowlines 51 are preferably comprised of metal alloy tubing which is bent to the desired loop configuration. The tubing must possess sufficient flexibility to accommodate the lateral stroking of manifold system connector means 56 within stress levels of less than 50 percent of yield strength. Connector mandrel 54 preferably has two conventional seal pockets to accept conventional extension subs in the running tool and preferably has an outer diameter of about 30 cm.

In the embodiments shown in FIGS. 1–5 and 8–9, wye spool 52 is about 1.5 meters in height, with a 34.6 cm, $3.45\times10^8$ dynes/cm$^2$ flanged bottom and a 22.9 cm, $3.45\times10^8$ dynes/cm$^2$ flanged top. Curved bores 52' have flanged ends for connecting the flexible flowlines 51. In such embodiments, swab valve block 53 is preferably a solid block composite gate valve design, with 10.2 cm and 5.1 cm valves. The valve block is preferably about 1 meter in height, with 22.9 cm, $3.45\times10^8$ cm$^2$ flanged ends, and the valve operators are preferably conventional hydraulically operated fail-safe close valves with manual override. Fabricated tubular spacer spool 55 is preferably about 3.3 meters high in these embodiments and preferably is comprised of two 22.9 cm, $3.45\times10^8$ dynes/cm$^2$ flanges at the ends and a 32.4 cm outer diameter heavy wall outer sleeve therebetween. Two tubing strings are preferably welded internally to each end of spacer spool 55 to provide through bore access.

In the embodiment shown in FIG. 7, wye spool 51 is eliminated and swab valve block 53 is preferably a solid block composite gate valve bolted to the top of wellhead connector 45 and having 12.7 cm and 5.1 cm valves. In this embodiment, valve block 53 is preferably about 1.2 meters in height, with a 34.6 cm flanged bottom and a 24.4 cm studded top. 12.7 cm and 5.08 cm studded side outlets are preferably located on opposite sides of the valve block and are operatively connected to flowlines 51. The valve operators are as described above in connection with FIGS. 1–5 and 8–9, and two extension subs preferably extend downwardly from valve block 53 to engage seal pockets in the top of wellhead 14 (or master valve assembly 50). In the embodiment shown in FIG. 7, tubular spacer spool 55 is bolted to the top of swab valve block 53 and preferably is about 2.4 meters in height. Spool 55 is generally similar to that described in connection with FIGS. 1–5 and 8–9 in its other respects.

The upper guidance structure of base template 11 is preferably sized and constructed such that, upon lowering, work enclosure hull 13 is oriented to within plus or minus one-half degree in rotation. The lower support system of base template 11 is preferably leveled to within plus or minus one-half degree of horizontal. For water depths in excess of 300 meters, preferably 8 or 9 wells are spaced about base template 11 at a common radius from the center of the template, and for operation at water depths on the order of 750 meters, base template 11 will preferably be circular in shape and have a diameter of about 19.5 meters and an overall height (bottom of lower support structure to top of upper guidance structure) of about 13.7 meters. Such a template, designed for up to 8 wells, will preferably have a well spacing of 6.7 meters radially. The well-to-well spacing is about 4.6 meters. The upper guidance structure is preferably about 9.8 meters in height, while the lower support structure has a height of about 3.96 meters. Typically the diameter of the wellheads of such a system is 42.5 cm.

In a well completion system designed for operation at water depths on the order of 750 meters, subsea work enclosure 13 preferably has an overall height of about 17.45 meters and an overall outer diameter of about 7.4 meters.

Other embodiments of the invention will be apparent to those skilled in the art from consideration of the specification and practice of the invention disclosed herein; and it is intended that the specification and examples be considered as exemplary only. Furthermore, it will be apparent to those skilled in the art that various modifications and variations can be made in the wellhead connection assembly and methods of installation of the present invention without departing from the scope or spirit of the invention. As an example, wellhead connection assembly 15 can be modified, as necessary, for use in operatively connecting a remote, satellite well (e.g. a well drilled off base template 11) to the manifold system in work enclosure hull 13. Thus, it is intended that the present invention cover the modifications and variations of this invention, provided they come within the scope of the appended claims and equivalents.

What is claimed is:

1. A subsea wellhead connection assembly for establishing fluid communication and production capability between a manifold system situated within a subsea work enclosure and an adjacent subsea wellhead located in a generally wedge-shaped well bay, comprising:

conduit means for fluidly connecting the wellhead and the manifold system, the conduit means having one end extending substantially horizontally and the other end extending downwardly;

wellhead connector means fluidly connected to the downwardly directed end of the conduit means for releasably connecting the conduit means to the wellhead upon downward movement of the assembly to establish fluid communication therebetween;

manifold system connector means fluidly connected to the horizontal end of the conduit means for releasably connecting the conduit means to the manifold system upon lateral movement of the manifold system connector means to establish fluid communication therebetween; and a guide frame rigidly secured to the wellhead connector means for supporting the manifold system connector means and the conduit means, and for vertically orienting the wellhead connector means over the wellhead and horizontally aligning the manifold system connector means with the manifold system, wherein the wedge-shaped well bay is defined by rigid vertical dividers supported on the marine floor, the vertical dividers extending along radially aligned planes so as to define opposite sides of a radially inwardly tapered well bay, and wherein the wedge-shaped sides of the guide frame are tapered similarly to the tapered well bay sides and said sides of the guide frame are sufficiently spaced apart and extend for a sufficient length and height to provide alignment of the guide frame as it is moved laterally during installation for orientation of the wellhead connection assembly over the wellhead.

2. A subsea wellhead connection assembly as claimed in claim 1, further comprising substantially vertically extending wellhead entry means rigidly supported within the confines of the guide frame and having an upper portion terminating at a connector mandrel extending upwardly from the top of the guide frame, said entry means being fluidly connected to the wellhead connector means for establishing fluid communication with the wellhead independent of the manifold system connector means.

3. A subsea wellhead connection assembly as claimed in claim 2, wherein the wellhead entry means includes a vertical wye spool having diverter valve means disposed therein.

4. A subsea wellhead connection assembly as claimed in claim 2, wherein the wellhead entry means includes swab valve means.

5. A subsea wellhead connection assembly as claimed in claim 1, wherein a circular guide ring extends from the upper periphery of the wellhead and wherein the assembly further comprises a downwardly-directed alignment funnel means rigidly attached to the wellhead connector means and extending from the lower periphery of the guide frame for contacting the guide ring as the assembly is lowered during its installation on the wellhead, thereby vertically aligning the wellhead connector means directly over the wellhead.

6. A subsea wellhead connection assembly for establishing fluid communication and production capability between a subsea wellhead and an adjacent subsea manifold system, comprising:

conduit means for fluidly connecting the wellhead and the manifold system, the conduit means having one end extending substantially horizontally and the other end extending downwardly;

wellhead connector means fluidly connected to the downwardly directed end of the conduit means for releasably connecting the conduit means to the wellhead upon downward movement of the assembly to establish fluid communication therebetween;

manifold system connector means fluidly connected to the horizontal end of the conduit means for releasably connecting the conduit means to the manifold system upon lateral movement of the manifold system connector means to establish fluid communication therebetween;

a guide frame rigidly secured to the wellhead connector means for supporting the manifold system connector means and the conduit means, and for vertically aligning the wellhead connector means over the wellhead and horizontally aligning the manifold system connector means with the manifold system; and mechanical linkage means supported by the guide frame and having a lever arm having one end attached to the manifold system connector means for laterally moving the manifold system connector means into operative connection with the manifold system and for reversing such operation to disconnect.

7. A subsea wellhead connection assembly as claimed in claim 6, wherein the mechanical linkage means further comprises an actuating member having one end extending substantially vertically upward and the other end extending downwardly within the guide frame, and a link member pivotally connected at one end to said other end of the actuating member, the link member being pivotally connected at its other end to the free end of the lever arm, whereby upward and downward movement of the actuating member is translated into lateral movement of the lever arm and the manifold system connector means.

8. A subsea wellhead connection assembly as claimed in claim 7, further comprising a support arm having one end pivotally attached to the guide frame and the other end pivotally attached to said other end of the link member for supporting the linkage means within the guide frame.

9. A subsea wellhead connection assembly as claimed in claim 6, further comprising at least one laterally extending guide pin rigidly attached to the manifold system connector means, and at least one vertical guide plate rigidly secured to the guide frame, said guide plate having a substantially horizontally extending slot for supporting and guiding the guide pin during lateral movement of the manifold system connector means; the guide pin, guide plate, and slot being relatively situated so as to align the manifold sytem connector means with the manifold system.

10. A subsea wellhead connection assembly for establishing fluid communication and production capability between a subsea wellhead supported on the peripheral portion of a circular marine floor base template and an adjacent subsea atmospheric manifold system supported on the central portion of the template, the wellhead being situated within a well bay defined by vertical dividers rigidly mounted on the template and extending inwardly toward said central portion from said peripheral portion along radially aligned planes, said assembly comprising:

conduit means for fluidly connecting the wellhead and the manifold system, the conduit means having one end extending substantially horizontally toward the central portion of the template and the other end extending downwardly;

wellhead connector means fluidly connected to the downwardly directed end of the conduit means and releasably connected to the wellhead so as to establish fluid communication between the wellhead and the conduit means;

manifold system connector means fluidly connected to the horizontal end of the conduit means and releasably connected to the manifold system so as to establish fluid communication between the conduit means and the wellhead; and a guide frame rigidly secured to the wellhead connector means for supporting the manifold system connector means and the conduit means, and for vertically aligning the wellhead connector means over the wellhead and horizontally aligning the manifold system connector means with the manifold system, the guide frame being mounted in the well bay on the marine floor base template.

11. A subsea wellhead connection assembly as claimed in claims 6 or 10, wherein the manifold system comprises a manifold means within an atmospheric, fluid-tight work enclosure hull and a penetrator means having one end fluidly connected to the manifold means and the other end extending substantially horizontally from the exterior of the work enclosure hull, the penetrator means being integral with said hull, and wherein the manifold system connector means is adapted for releasable fluid coupling to said other end of the penetrator means.

12. A subsea wellhead connection assembly as claimed in claims 6 or 10, wherein a master valve assembly is operatively connected between the wellhead and the wellhead connector means in fluid flow relationship.

13. A subsea wellhead connection assembly for establishing fluid communication and production capability between a subsea wellhead and an adjacent subsea atmospheric manifold system and for establishing fluid communication between the wellhead and a connector mandrel, comprising:

first conduit means curved in a loop traversing at least about one full turn for fluidly connecting the wellhead and the manifold system, the first conduit means having one end extending substantially horizontally and the other end situated below the horizontal end;

wellhead connector means fluidly connected to said other end of the first conduit means for releasably connecting the first conduit means to the wellhead upon downward movement of the assembly to establish fluid communication therebetween;

manifold system connector means fluidly connected to the horizontal end of the first conduit means for releasably connecting the first conduit means to the manifold system upon lateral movement of the manifold system connector means to establish fluid communication therebetween, the manifold system connector means having a pair of guide pins extending substantially horizontally from opposing sides of the connector means to permit alignment during horizontal movement of said manifold system connector means;

substantially vertically extending second conduit means having a downwardly directed end fluidly connected to the wellhead connector means and an upwardly directed end fluidly connected to the connector mandrel for establishing fluid communication between the wellhead and the mandrel independent of the manifold system connector means;

a protective guide frame comprised of rigid structural piping for supporting and surrounding the manifold system connector means and the first and second conduit means, and for vertically aligning the wellhead connector means over the wellhead and horizontally aligning the manifold system connector means with the manifold system, the guide frame comprising upper and lower support members having substantially identical outer peripheries, when viewed from above, and vertical tubular members rigidly connected between the upper and lower support members, the lower support member being rigidly attached to the wellhead connector means and the upper support member being rigidly attached to the upwardly directed end of the second conduit means;

mechanical linkage means supported by the guide frame and having a lever arm having one end attached to the manifold system connector means for laterally moving the manifold system connector means into operative connection with the manifold system, and for reversing such operation to disconnect, the mechanical linkage means further having an actuating member pivotally connected to the lever arm, the actuating member having its free end extending substantially vertically upward; and a pair of substantially oppositely facing guide plates rigidly attached to at least one of the vertical members of the guide frame, each guide plate having a slot for supporting and guiding the respective manifold system connector guide pins during lateral movement of the manifold system connector means, the guide pins, guide plates and slots being relatively situated so as to align the manifold system connector means with the manifold system.

14. A subsea wellhead connection assembly as claimed in claim 13, wherein the first conduit means comprises a plurality of flexible loop flowlines, at least one of the flowlines being curved in a substantially horizontally extending loop traversing about one and one-half full turns.

15. A subsea wellhead connection assembly for establishing fluid communication and production capability between a subsea wellhead and an adjacent subsea hull penetrator and for establishing fluid communication between the wellhead and a connector mandrel, comprising:

a plurality of flexible loop flowlines for fluidly connecting the wellhead and the penetrator, at least one of the flowlines being curved in a substantially vertically extending loop traversing about one full turn and on a radius of at least 1.52 meters for permitting passage of well pump-down tools therethrough, the flowlines each having one end extending substantially horizontally and the other end extending downwardly;

wellhead connector means fluidly connected to the downwardly directed ends of the flowlines for releasably connecting the flowlines to the wellhead upon downward movement of the assembly to establish fluid communication therebetween;

penetrator connector means fluidly connected to the horizontal ends of the flowlines for releasably connecting the flowlines to the penetrator upon lateral movement of the penetrator connector means to establish fluid communication therebetween;

substantially vertically extending conduit means having a downwardly directed end fluidly connected to the wellhead connector means and an upwardly directed end fluidly connected to the connector mandrel for establishing fluid communication between the wellhead and the mandrel independent of the penetrator, the conduit means including swab valve means and a vertical wye spool having diverter valve means disposed therein;

a protective guide frame including rigid structural piping for supporting and surrounding the penetrator connector means, the conduit means, and the flowlines, and for vertically aligning the wellhead connector means over the wellhead and horizontally aligning the penetrator connector means with the penetrator, the guide frame comprising upper and lower support members having substantially identical outer peripheries, when viewed from above and vertical members rigidly connected between the upper and lower support members, the lower support member being rigidly attched to the wellhead connector means and the upper support member being rigidly attached to the conduit means; and mechanical linkage means supported by the guide frame and having a lever arm having one end attached to the penetrator connector means for laterally moving the penetrator connector means into operative connection with the penetrator, and for reversing such operation to disconnect, the mechanical linkage means further having an actuating member pivotally connected to the lever arm, the actuating member having its free end extending substantially vertically upward.

16. A method of establishing fluid communication and production capability between a marine floor wellhead and an adjacent subsea manifold system, comprising:

providing a wellhead connection assembly comprising conduit means for fluidly connecting the wellhead and the manifold system, the conduit means having one end extending substantially horizontally and the other end situated below the horizontal end, wellhead connector means fluidly connected to said other end of the conduit means, manifold system connector means fluidly connected to the horizontal end of the conduit means, and a guide frame rigidly secured to the wellhead connector means for supporting the manifold system connector means and the conduit means;

laterally moving the wellhead connection assembly into a generally wedge-shaped well bay defined by vertical dividers, wherein two opposing sides of the guide frame are similarly wedge-shaped and the assembly is guided into position above the wellhead by the vertical dividers;

releasably connecting the wellhead connector means to the wellhead, thereby establishing fluid communication between the wellhead and the conduit means; and then horizontally moving the manifold system connector into operative connection with the manifold system, thereby establishing fluid communication between the conduit means and the manifold system.

17. A method of establishing fluid communication and production capability between a marine floor wellhead and an adjacent subsea manifold system, comprising:

providing a wellhead connection assembly comprising conduit means for fluidly connecting the wellhead and the manifold system, the conduit means having one end extending substantially horizontally and the other end situated below the horizontal end, wellhead connector means fluidly connected to said other end of the conduit means, manifold system connector means fluidly connected to the horizontal end of the conduit means, and a guide frame rigidly secured to the wellhead connector means for supporting the manifold system connector means and the conduit means;

lowering the wellhead connection assembly;

providing a circular guide ring extending from the upper periphery of the wellhead, providing the wellhead connection assembly with a downwardly-directed alignment funnel means rigidly attached to the wellhead connector means and extending from the lower periphery of the guide frame, and contacting the guide ring with the inner periphery of the alignment funnel as the assembly is lowered during its installation on the wellhead, thereby vertically aligning the wellhead connector means directly over the wellhead;

providing the wellhead connection assembly with mechanical linkage means supported by the guide frame and having a lever arm having one end attached to the manifold system connector means, and exerting a force on the lever arm so as to laterally move the manifold system connector means into operative connection with the manifold system;

releasably connecting the wellhead connector means to the wellhead, thereby establishing fluid communication between the wellhead and the conduit means; and then horizontally moving the manifold system connector into operative connection with the manifold system, thereby establishing fluid communication between the conduit means and the manifold system.

* * * * *